US009184531B2

(12) United States Patent
Chen

(10) Patent No.: US 9,184,531 B2
(45) Date of Patent: Nov. 10, 2015

(54) RECEPTACLE CONNECTOR

(71) Applicant: Tyco Electronics Holdings (Bermuda) No. 7 Ltd., Pembroke (BM)

(72) Inventor: Chin Yu Chen, Taipei (TW)

(73) Assignee: Tyco Electronics Holdings (Bermuda) No. 7 Ltd., Pembroke (BM)

( * ) Notice: Subject to any disclaimer, the term of this patent is extended or adjusted under 35 U.S.C. 154(b) by 277 days.

(21) Appl. No.: 13/679,366

(22) Filed: Nov. 16, 2012

(65) Prior Publication Data

US 2013/0143444 A1 Jun. 6, 2013

(30) Foreign Application Priority Data

Nov. 18, 2011 (TW) ..... 100221921 U
Jul. 23, 2012 (TW) ..... 101214176 U

(51) Int. Cl.
*H01R 13/518* (2006.01)
*H01R 12/75* (2011.01)
*H01R 13/639* (2006.01)

(52) U.S. Cl.
CPC ..... *H01R 13/518* (2013.01); *H01R 12/75* (2013.01); *H01R 13/639* (2013.01)

(58) Field of Classification Search
CPC ..... H01R 23/7063; H01R 13/518
USPC ..... 439/626, 569–571, 76.1, 135, 136, 260
See application file for complete search history.

(56) References Cited

U.S. PATENT DOCUMENTS 4,639,063 A * 1/1987 Mueller ..... 439/325
5,320,550 A 6/1994 Uratsuji et al.
5,320,552 A 6/1994 Reichardt et al.
5,533,908 A * 7/1996 Henry et al. ..... 439/329
5,961,347 A * 10/1999 Hsu ..... 439/570
6,152,766 A * 11/2000 Wu et al. ..... 439/570
6,579,122 B1 * 6/2003 Chen ..... 439/570
7,371,095 B2 5/2008 Takahashi
7,390,216 B1 * 6/2008 Lee ..... 439/570
7,458,822 B2 * 12/2008 Ono ..... 439/570
8,052,457 B2 * 11/2011 Miyazaki et al. ..... 439/357

(Continued)

FOREIGN PATENT DOCUMENTS

CN 101308965 A 11/2008
EP 0905827 A2 3/1999
JP 109185 U 7/1989

(Continued)

*Primary Examiner* — Briggitte R Hammond
(74) *Attorney, Agent, or Firm* — Barley Snyder

(57) ABSTRACT

A receptacle connector is provided and includes an insulating case, a securing device and a cover. The insulating casing includes a plurality of terminal receiving passageways, a plug receiving space, a pair of protrusions on two sides of the plug receiving space. A securing device receiving space is disposed on one of the two sides. The securing device includes a horizontal portion, a first vertical portion and a second vertical portion extending downward from the horizontal portion, a first soldering portion extending horizontally from the first vertical portion, a second soldering portion extending horizontally from the second vertical portion. An engagement portion is positioned between the first vertical portion and the second vertical portion. The cover is pivotally connected to the insulating casing and includes a first protrusion receiving passageway and a second protrusion receiving passageway which communicate with each other and correspond in position with the pair of protrusions.

31 Claims, 17 Drawing Sheets

(56) References Cited

U.S. PATENT DOCUMENTS

| | | | | |
|---|---|---|---|---|
| 8,133,067 | B2 * | 3/2012 | Tsai et al. | 439/260 |
| 8,137,131 | B2 * | 3/2012 | Wang et al. | 439/570 |
| 2004/0014335 | A1 * | 1/2004 | Igarashi et al. | 439/74 |
| 2008/0032526 | A1 | 2/2008 | Takahashi | |
| 2008/0188115 | A1 * | 8/2008 | Watanabe | 439/353 |
| 2009/0181573 | A1 * | 7/2009 | Wang et al. | 439/463 |
| 2010/0081300 | A1 * | 4/2010 | Hsu et al. | 439/76.1 |
| 2010/0142895 | A1 * | 6/2010 | Hsu | 439/65 |

FOREIGN PATENT DOCUMENTS

| | | | |
|---|---|---|---|
| TW | 304799 | U | 1/2007 |
| TW | 359065 | U | 6/2009 |
| TW | 385815 | U | 8/2010 |
| TW | 400135 | U1 | 3/2011 |
| WO | 2006020715 | A1 | 2/2006 |

* cited by examiner

RECEPTACLE CONNECTOR

CROSS-REFERENCE TO RELATED APPLICATIONS

This application claims the benefit of the filing dates under 35 U.S.C. §119(a)-(d) of TW UM Application No. 100221921, filed on Nov. 18, 2011, and TW UM Application 101214176, filed on Jul. 23, 2012.

FIELD OF THE INVENTION

The invention relates to a receptacle connector and, more particularly, to a board-to-cable receptacle connector.

BACKGROUND

With the development in technology, a wide variety of electronic products require enhancement in stability of electronic components, to achieve better electrical performance and suit the ever-intricate operation environment. The main purpose of known connectors is to serve as an important medium of connection and signal transmission between electronic products.

In general, a known board-to-cable connector includes a receptacle connector and a cable plug connector. Taiwan patent M400135 discloses an electrical connector assembly having a plug connector and a receptacle connector. The plug connector includes a plug casing and a plug contact. A first holding portion is disposed at an end of each of two external sides of the plug casing. A clamping portion is disposed at one end of the plug contact. The receptacle connector has a receptacle casing and a receptacle contact. A second holding portion is disposed on each of two internal sides of the receptacle casing and corresponds in position to the first holding portion of the plug casing. After the plug connector has been pressed down to connect with the receptacle connector, the clamping portion accommodates and clamps the receptacle contact, whereas the second holding portion engages the first holding portion.

In other known connectors, for use with conventional SIM cards, a pivotal lid is used in connection with an insulating casing (for instance, see U.S. Pat. No. 5,320,552, EP 0905827, WO 2006020715, and CN 101308965A). Other known receptacle connectors, disclosed in U.S. Pat. No. 7,371,095 and TWM 304799, include the aforesaid pivotal lid connected to a wire plug. In known connectors, disclosed in JP1-109185, TWM359065, and TWM385815, a stopping/securing device is disposed on the aforesaid pivotal lid.

However, since electrical connectors are continually required to be made smaller in volume, constituent elements thereof have to be made smaller as well. Accordingly, it is an objective to reinforce the connection structure between a cable plug and a receptacle connector.

SUMMARY

A receptacle connector is provided and includes an insulating case, a securing device and a cover. The insulating casing includes a plurality of terminal receiving passageways, a plug receiving space, a pair of protrusions on two sides of the plug receiving space. A securing device receiving space is disposed on one of the two sides. The securing device includes a horizontal portion, a first vertical portion and a second vertical portion extending downward from the horizontal portion, a first soldering portion extending horizontally from the first vertical portion, a second soldering portion extending horizontally from the second vertical portion. An engagement portion is positioned between the first vertical portion and the second vertical portion. The cover is pivotally connected to the insulating casing and includes a first protrusion receiving passageway and a second protrusion receiving passageway, which communicate with each other and correspond in position with the pair of protrusions.

DETAILED DESCRIPTION OF THE EMBODIMENT(S)

Although the invention is described below through exemplary embodiments thereof and the accompanying drawings, a person skilled in the art should understand that they can revise the exemplary embodiments described hereunder and still achieve the functions and advantages of the invention. Hence, persons skilled in the art understand that the description of the exemplary embodiments of the invention is a general illustration of the invention and is not restrictive of the invention.

Figure 1:
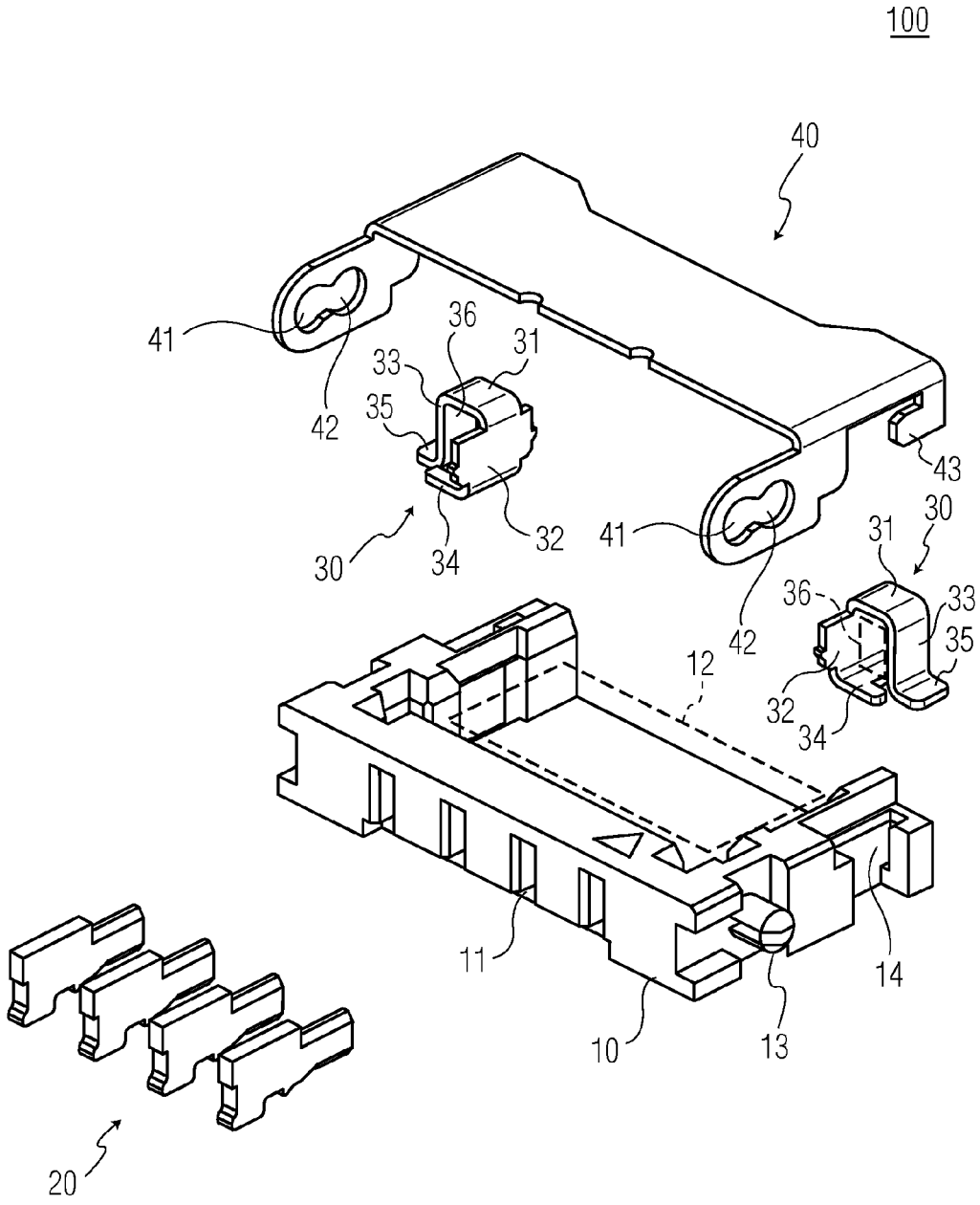
FIG. 1 is an exploded view of a receptacle connector according to the invention.

Referring to FIG. 1, a receptacle connector 100 according to the invention is shown, whereby a cable plug connector 1 is secured therein and electrically connected to a circuit board 2.

The receptacle connector includes an insulating casing 10, a plurality of terminals 20, a pair of securing devices 30, and a cover 40.

The insulating casing 10 has a front end with a plurality of terminal receiving passageways 11 and has a rear end with a plug receiving space 12. Protrusions 13 are disposed on two sides of the plug receiving space 12 and positioned proximate to the terminal receiving passageways 11, respectively. The securing device receiving spaces 14 are disposed on two sides of the plug receiving space 12 and positioned distal to the terminal receiving passageways 11, respectively. The terminals 20 are disposed in the terminal receiving passageways 11 of the insulating casing 10, respectively, and extend therethrough.

Each of the pair of securing devices 30 are disposed in the securing device receiving spaces 14, respectively. Each pair of securing devices 30 include a horizontal portion 31, a vertical portion formed by bending the horizontal portion 31 downward, and a fixed connection portion bent from the vertical portion horizontally. In shown embodiment, the vertical portion includes a first vertical portion 32 and a second vertical portion 33, whereas the fixed connection portion includes a first soldering portion 34 and a second soldering portion 35. With the first vertical portion 32 extending horizontally to form the first soldering portion 34 and the second vertical portion 33 extending horizontally to form the second soldering portion 35, both the first soldering portion 34 and the second soldering portion 35 are soldered to the circuit board 2 in order to secure the insulating casing 10 in place.

An engagement portion 36 is defined by and between the first vertical portion 32 and the second vertical portion 33.

The cover 40 is disposed on the insulating casing 10. In the embodiment shown, the cover 40 is rotatable lid. Accordingly, the cover 40 includes a first protrusion receiving passageway 41 and a second protrusion receiving passageway 42, which communicate with each other and correspond in position to the protrusions 13 of the insulating casing 10, respectively. The first protrusion receiving passageway 41 and the second protrusion receiving passageway 42 are disposed along the cover 40. Additionally, the cover 40 includes engagement pieces 43 corresponding in position to the engagement portions 36 of the pair of securing devices 30, respectively, are also disposed along the cover 40.

In the shown embodiment, the protrusions 13 of the insulating casing 10 are cylindrical, the securing device receiving spaces 14 are substantially T-shaped, and the pair of securing devices 30 are substantially inverted U-shaped. The first vertical portions 32 engage with the securing device receiving spaces 14. The first protrusion receiving passageway 41 and the second protrusion receiving passageway 42 are two round holes, respectively, and communicate with each other. The engagement pieces 43 are substantially barb-shaped in the embodiment shown.

In the shown embodiment, the pair of securing devices 30 and the cover 40 are made of a rigid material, such as a metal.

Figure 2:
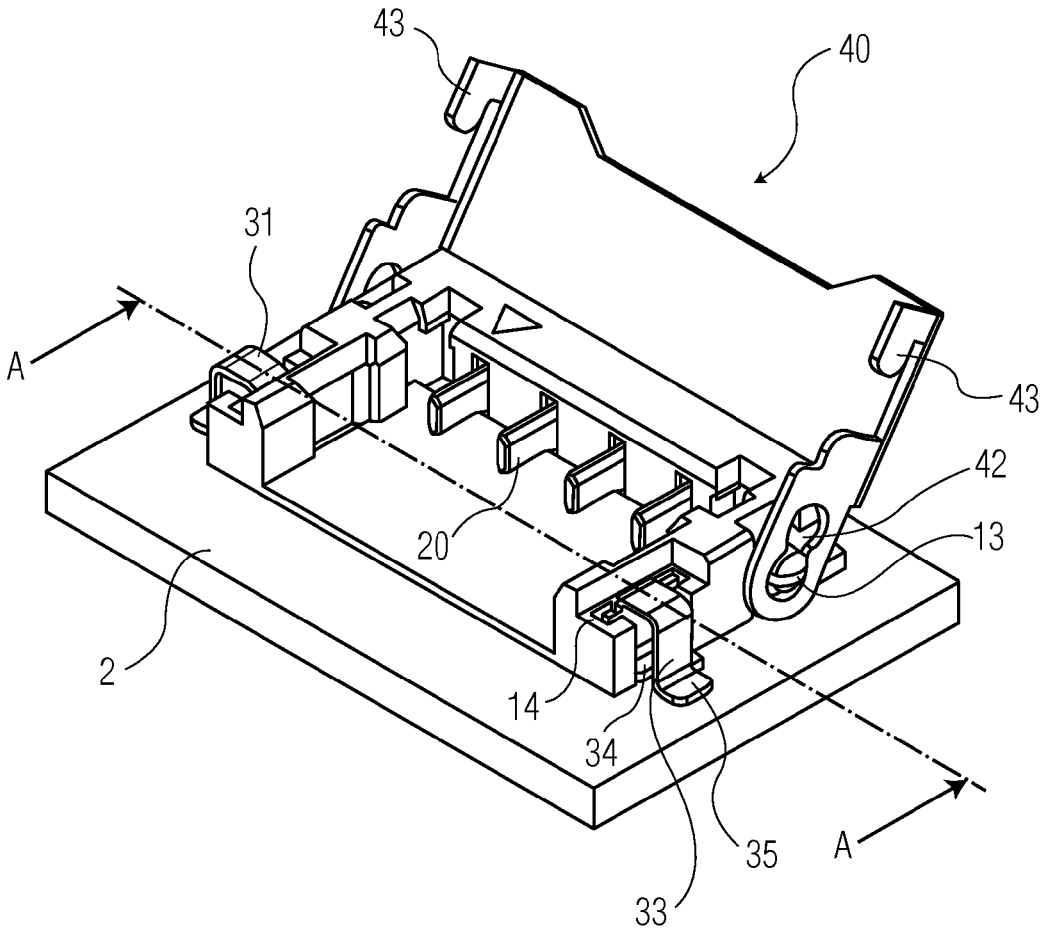
FIG. 2 is a perspective view of the receptacle connector according to the invention, shown as assembled and secured to a circuit board.
Figure 3:
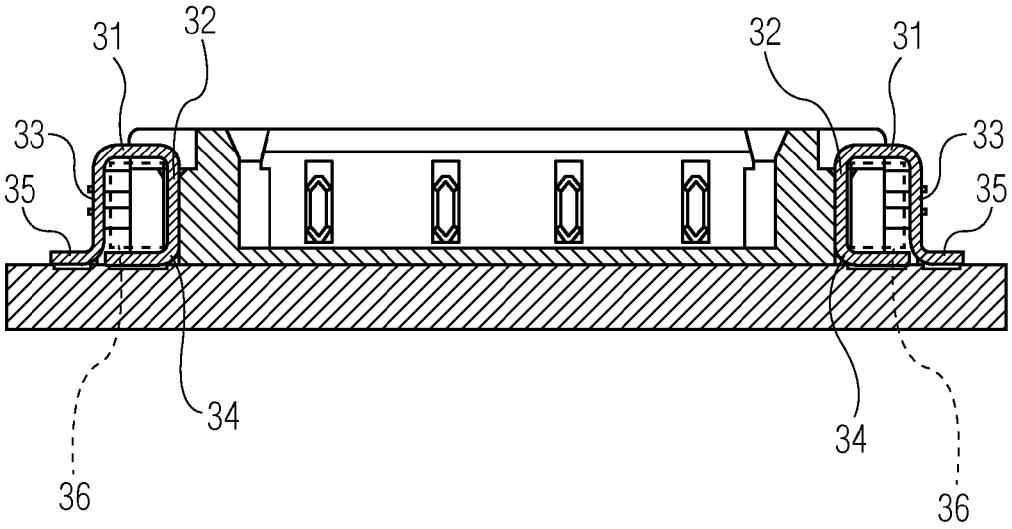
FIG. 3 is a cross-sectional view of the receptacle connector of FIG. 2 taken along line A-A.

The receptacle connector 100 according to the invention is further illustrated with reference to FIGS. 1, 2, and 3.

In assembling the receptacle connector 100 according to the invention, the terminals 20 are inserted into the terminal receiving passageways 11 of the insulating casing 10, respectively. The first vertical portions 32 of the pair of securing devices 30 engage the securing device receiving spaces 14 on the two sides of the insulating casing 10, respectively. Next, the first soldering portion 34 and the second soldering portion 35 are secured to the circuit board 2 by performing a soldering process. The first protrusion receiving passageway 41 of the cover 40 are connected to the protrusions 13 disposed on sides of the insulating casing 10 in the embodiment shown. The cover 40 and the insulating casing 10 are connected such that the cover 40 can pivotally rotate about the protrusions 13. The cylindrical protrusions 13 pass through and engage with the round first protrusion receiving passageway 41 to thereby enable the cover 40 to rotate about the protrusions 13 pivotally, upward, and downward. The engagement pieces 43 of the cover 40 engage with the engagement portions 36, respectively, such that the cover 40 is firmly fixed to the insulating casing 10. In the embodiment shown, the engagement pieces 43 snap fit with the engagement portions.

Now with reference to FIG. 4 through FIG. 8, the receptacle connector 100 is shown soldered to a circuit board 2 and assembled with a cable plug connector 1.

Figure 4:
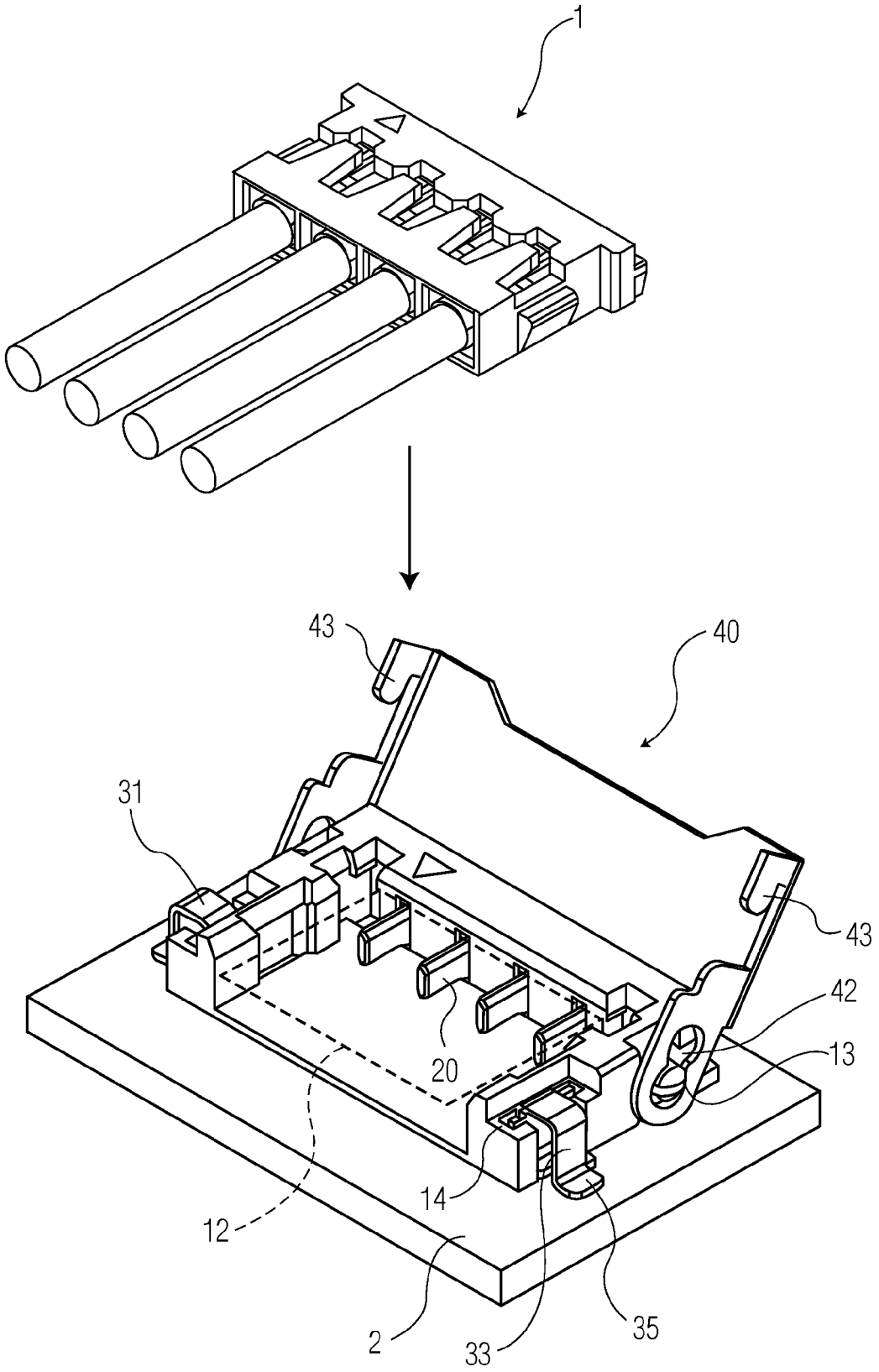
FIG. 4 is an exploded view of the receptacle connector according to the invention, shown secured to the circuit board and in assembly with a cable plug connector.
Figure 5:
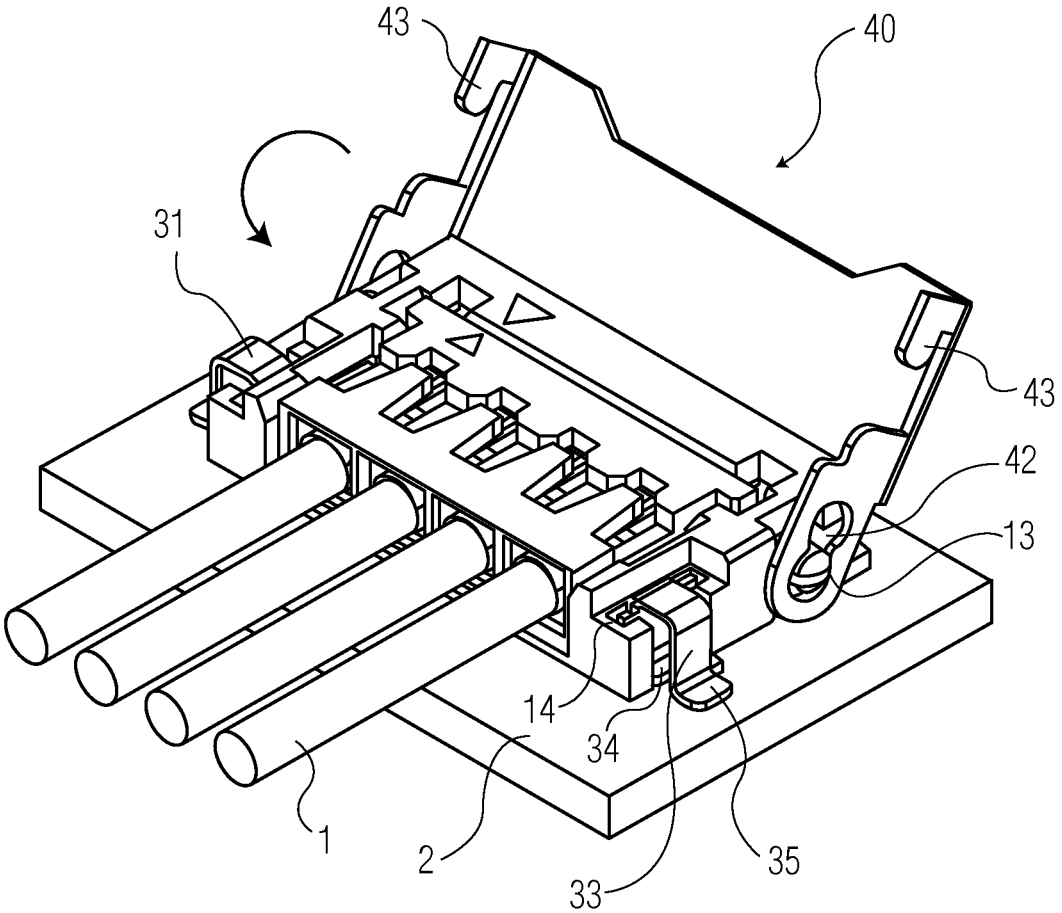
FIG. 5 is a perspective view of the receptacle connector according to the invention, shown assembled with the circuit board and the cable plug connector.
Figure 6:
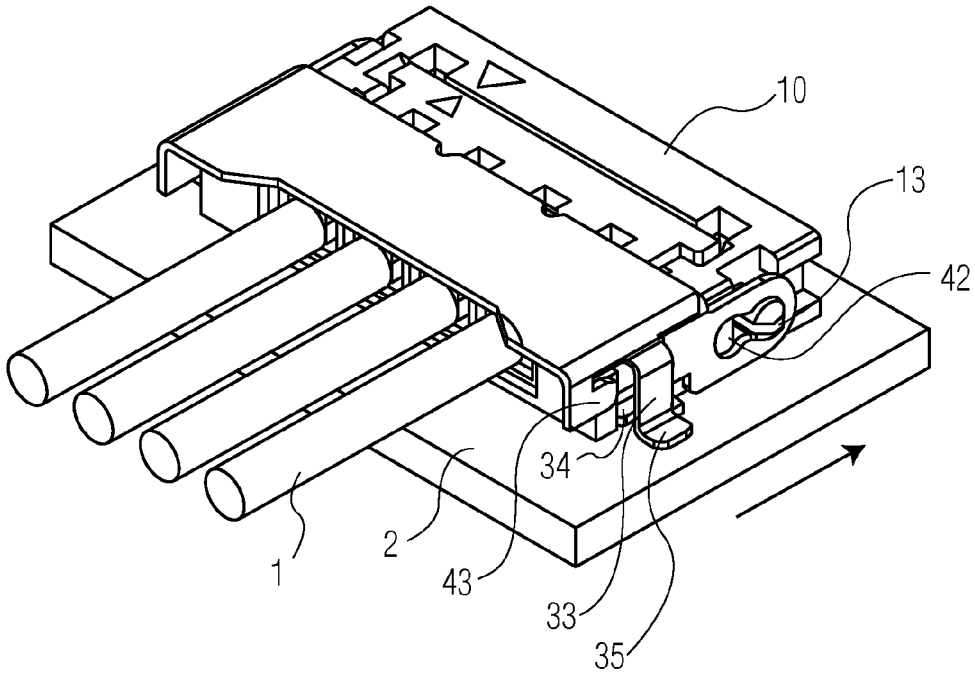
FIG. 6 is a perspective view of a cover of the receptacle connector according to the invention.
Figure 7:
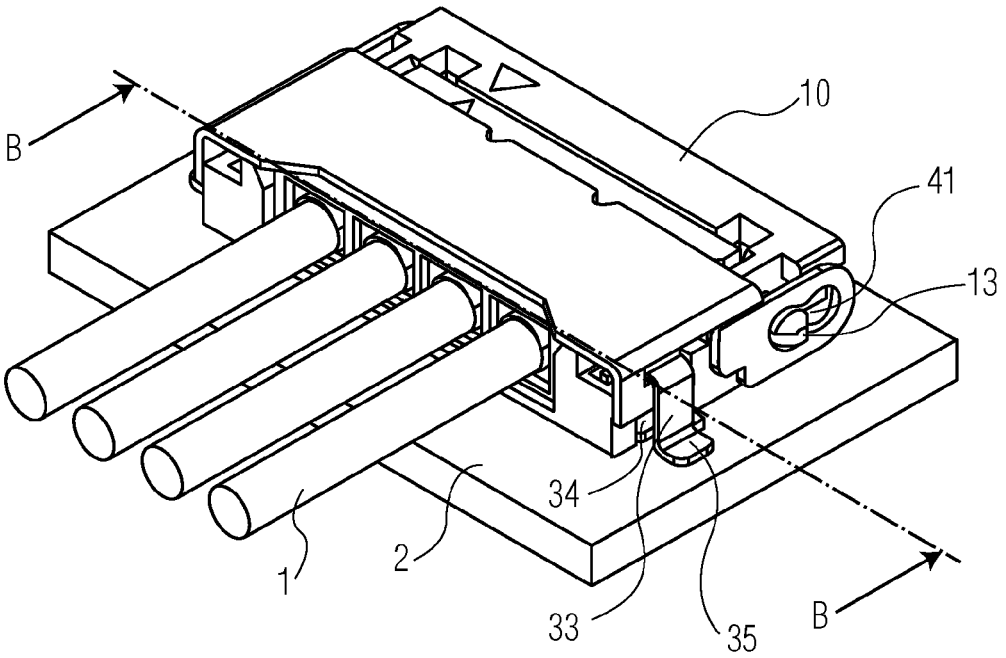
FIG. 7 is another perspective view of the receptacle connector according to the invention, after being secured to the circuit board and the cable plug connector.
Figure 8:
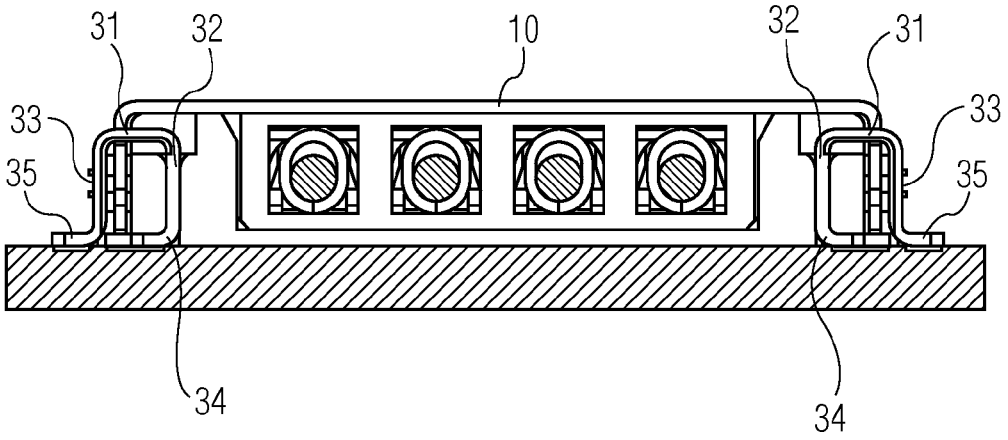
FIG. 8 is a cross-sectional view of the receptacle connector of FIG. 7, taken along line B-B.

The cable plug connector 1 is electrically connected to the receptacle connector 100 that is secured to the circuit board 2 by soldering in the shown embodiment. The cable plug connector 1 is inserted or positioned into the plug receiving space 12 as shown in FIG. 4. The cylindrical protrusions 13 that positioned in and engage with the round first protrusion receiving passageway 41 allow rotate the cover 40 to rotate downward about the protrusions 13 as shown in FIG. 5, such that the cable plug connector 1 is covered by the cover 40 when closed over the insulating casing 10. Meanwhile, the protrusions 13 are aligned with the first protrusion receiving passageway 41, whereas the engagement pieces 43 of the cover 40 are aligned with and positioned outside the engagement portions 36 as shown in FIG. 6. The cover 40 is then pushed horizontally toward the front end, in order to cause the protrusions 13 to move from the first protrusion receiving passageway 41 to the second protrusion receiving passageway 42 and cause the engagement pieces 43 to engage with the engagement portions 36, respectively. Accordingly, the cable plug connector 1 is secured and electrically connected to the receptacle connector 100, as shown in FIG. 7. The first soldering portion 34 and the second soldering portion 35 are secured to the circuit board 2 by performing a soldering process thereon with a solder, such that the receptacle connector 100 of the invention is firmly secured to the circuit board 2, as shown in FIG. 8.

Next, another embodiment of the receptacle connector according to the invention will be described with reference to FIGS. 9-17. For sake of brevity, descriptions of the configurations common to those of the aforementioned embodiment may be omitted.

Figure 9:
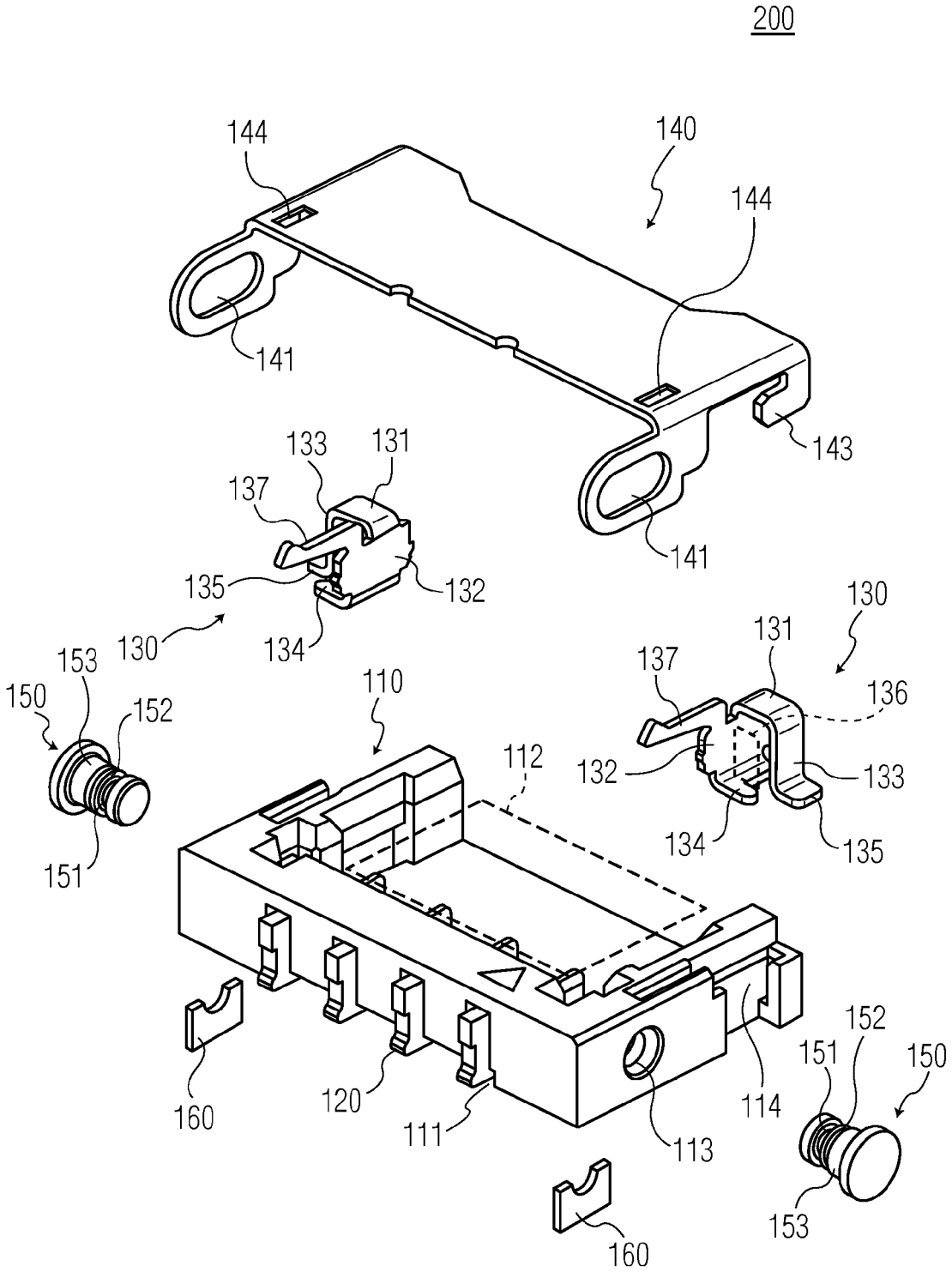
FIG. 9 is an exploded view of another receptacle connector according to the invention.
Figure 10:
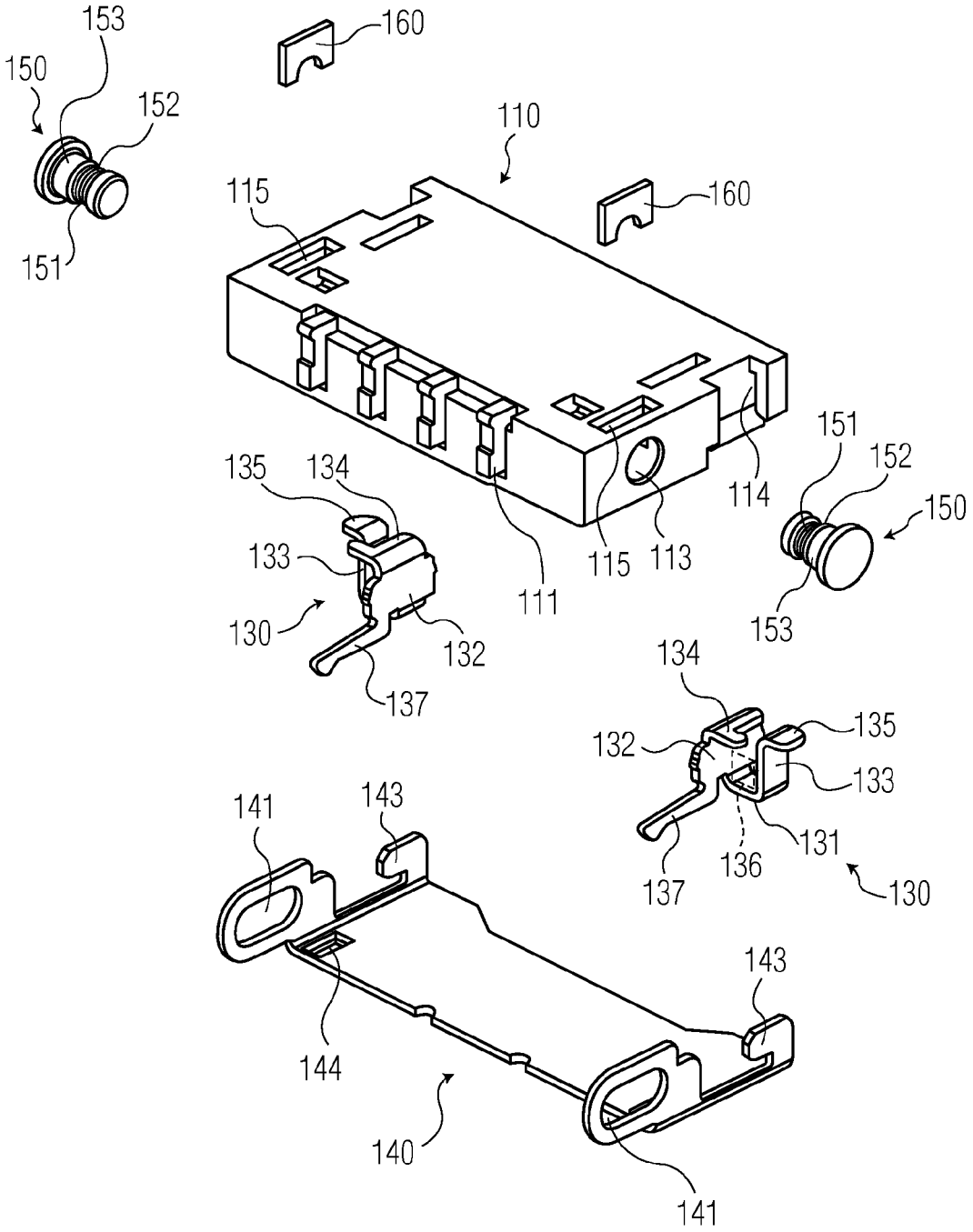
FIG. 10 is an exploded view of the receptacle connector shown in FIG. 9.
Figure 11:
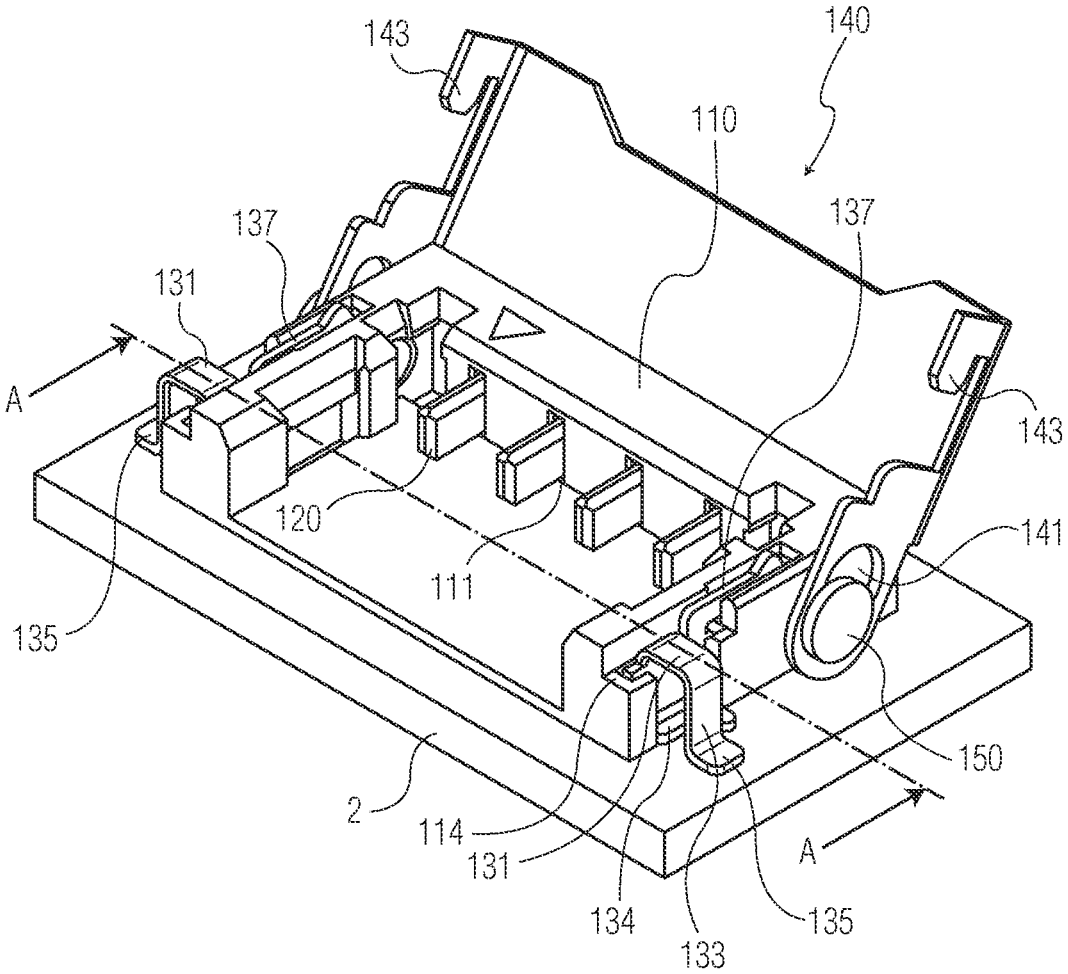
FIG. 11 is a perspective view of the receptacle connector of FIG. 9, shown assembled and secured to a circuit board.
Figure 12:
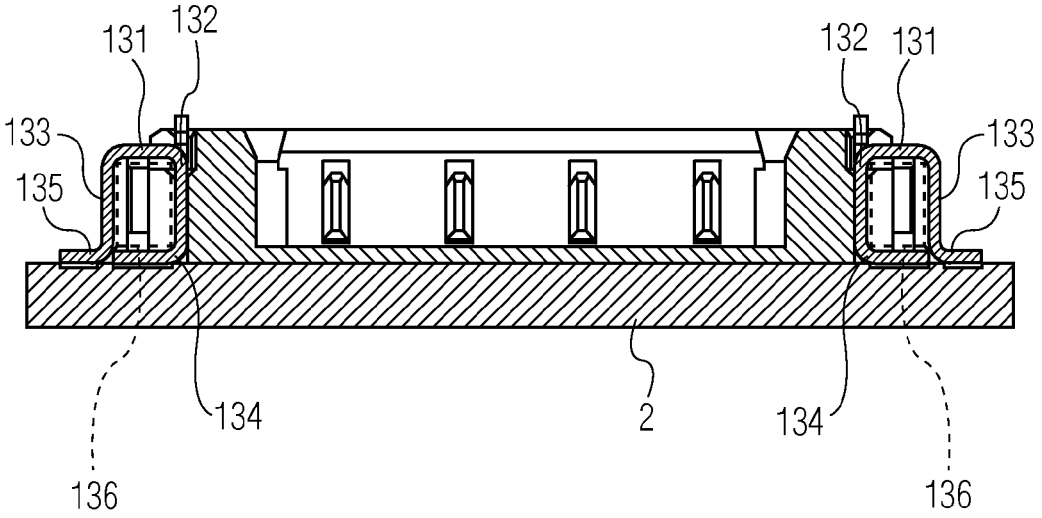
FIG. 12 is a cross-sectional view of the receptacle connector of FIG. 11 taken along line A-A.

With reference to FIG. 9 and FIG. 10, a receptacle connector 200 is shown which receives the cable plug connector 1 and electrically connects to the circuit board 2.

The receptacle connector 200 includes the insulating casing 110, a lid 140, and a pair of securing devices 130. Like described above, the insulating casing 110 includes a plug receiving space 112 for receiving the cable plug connector 1, an open end from which a cable of the cable plug connector 1 extends, and a terminal receiving portion 111 corresponding in position to the open end. A conductive terminal 120 inside the terminal receiving portion 111 is electrically connected to another conductive terminal of the cable plug connector 1.

The lid 140 is pivotally connected to two opposing sides of the insulating casing 110, wherein the two opposing sides of the insulating casing 110 adjoin the terminal receiving portion 111. A connection element receiving space 141 and an engagement piece 143 opposing each other are disposed on two opposing sides of the lid 140, respectively.

The pair of securing devices 130 are disposed on the insulating casing 110, pivotally connected to the edge of the lid 140, and positioned distal to the point of pivotal connection between the insulating casing 110 and the lid 140. As a result, the receptacle connector 200 of the invention is secured to the circuit board 2, whereas the plug receiving space 112 is covered by the lid 140 to thereby allow the connection element receiving space 141 and the engagement piece 143 of the lid 140 to move horizontally relative to the point of pivotal connection of the insulating casing 110 and ensure that the plug receiving space 112 for receiving the cable plug connector 1 can be firmly covered with the lid 140 even if the lid 140 is lifted.

A catch 137 is disposed on each of the pair of securing devices 130 and a catch receiving passageway 144 is disposed on the surface of the lid 140 such that the catch and the catch receiving passageway correspond with each other, so as to reinforce and secure the lid 140 in place.

Referring to FIG. 9 and FIG. 10, a connection element portion 113 is disposed on the insulating casing 110 and corresponds in position to the connection element receiving space 141 on the two opposing sides of the lid 140. A securing device receiving space 114 is disposed on the insulating casing 110, positioned distal to the terminal receiving portion 211, and positioned corresponding to the pair of securing devices 130. The pair of securing devices 130 are disposed in the securing device receiving space 114. A stopper receiving passageway 115 is disposed on the bottom side of the insulating casing 110.

The pair of securing devices 130 include a horizontal portion 131 as well as a first vertical portion 132 and a second vertical portion 133 which extend downward from the horizontal portion 131. The first vertical portion 132 extends upward to form the catch 137. The bottom end of the first vertical portion 132 extends horizontally to form a first soldering portion 134. The bottom end of the second vertical portion 133 extends horizontally to form a second soldering portion 135. The first soldering portion 134 and the second soldering portion 135 are soldered to the circuit board 2 to enable the insulating casing 110 to be secured in place. An engagement portion 136 is defined by and between the first vertical portion 132 and the second vertical portion 133. The engagement portion 136 is engaged with the engagement piece 143 of the lid 140.

The receptacle connector 200 of the invention further includes a pair of connection elements 150 and a pair of stoppers 160. The pair of connection elements 150 include a holding portion 151, a second connecting portion 152, and a pivotal connection portion 153. The second connecting portion 152 is disposed between the holding portion 151 and the pivotal connection portion 153. The second connecting portion 152 is connected to the connection element portion 113. The holding portion 151 corresponds in position to the stopper receiving passageway 115 of the insulating casing 110 and is disposed in the plug receiving space 112. The pivotal connection portion 153 is disposed outside the insulating casing 110 and disposed on one side of the connection element receiving space 141. A pair of stoppers 160 penetrates the stopper receiving passageway 115 of the insulating casing 110 to engage with the holding portion 151 of the connection elements 150 to reinforce and secure the connection between the insulating casing 110 and the pair of connection elements 150.

In shown embodiment, the connection element portion 113 of the insulating casing 110 is a screw hole. The securing device receiving space 114 of the insulating casing 110 is a recess. The pair of securing devices 130 are substantially inverted U-shaped. The recess matches the pair of securing devices 130 in shape and structure. The free end of the catch 137 formed by extending the first vertical portion 132 upward is triangular, in the embodiment shown. The connection element receiving space 141 of the lid 140 is oval-shaped. The engagement piece 143 is substantially barb-shaped and the pair of connection elements 150 are rivet-shaped. The holding portion 151 and the pivotal connection portion 153 are cylindrical, and the second connecting portion 152 is threaded. The stoppers 160 are semicircular laterally.

In the shown embodiment, the lid 140, the pair of securing devices 130, and the pair of connection elements 150 are made of a rigid material, such as a metal.

With reference to FIGS. 9 through 12, assembly of the receptacle connector 200 according to the invention will be described. The first vertical portions 132 of the pair of securing devices 130 engage with the securing device receiving spaces 114 on the two sides of the insulating casing 110, respectively, such that the securing device 130 snap fits with the securing device receiving space 114. The first soldering portion 134 and the second soldering portion 135 are secured to the circuit board 2 using a soldering process thereon with a solder. The lid 140 is connected to two opposing sides of the insulating casing 110 to align the connection element receiving space 141 with the connection element portion 113 of the insulating casing 110 such that lid is pivotally rotatable about the insulating casing 110. The two opposing sides of the insulating casing 110 adjoin the terminal receiving portion 111. The thread of the second connecting portion 152 connect with a screw hole of the connection element portion 113 to enable the lid 140 to be secured along the insulating casing 110. Meanwhile, the pair of connection elements 150 are disposed on one side of the connection element receiving space 141, whereas the cylindrical pivotal connection portion 153 meshes with the oval-shaped connection element receiving space 141 to thereby enable the lid 140 to rotate about the pivotal connection portion 153 pivotally, upward, and downward. The stopper receiving passageway 115 is aligned with the holding portion 151 of the pair of connection elements 150 to allow the stoppers 160 to penetrate the stopper receiving passageway 115 of the insulating casing 110 and engage with the holding portion 151 of the pair of connection elements 150. As a result, the connection between the insulating casing 110 and the pair of connection elements 150 is reinforced and secured and, eventually, the engagement piece 143 engage with the engagement portion 136, and the catch 137 engage with the catch receiving passageway 144 of the lid 140, such that the lid 140 is firmly secured to the insulating casing 110.

Figure 13:
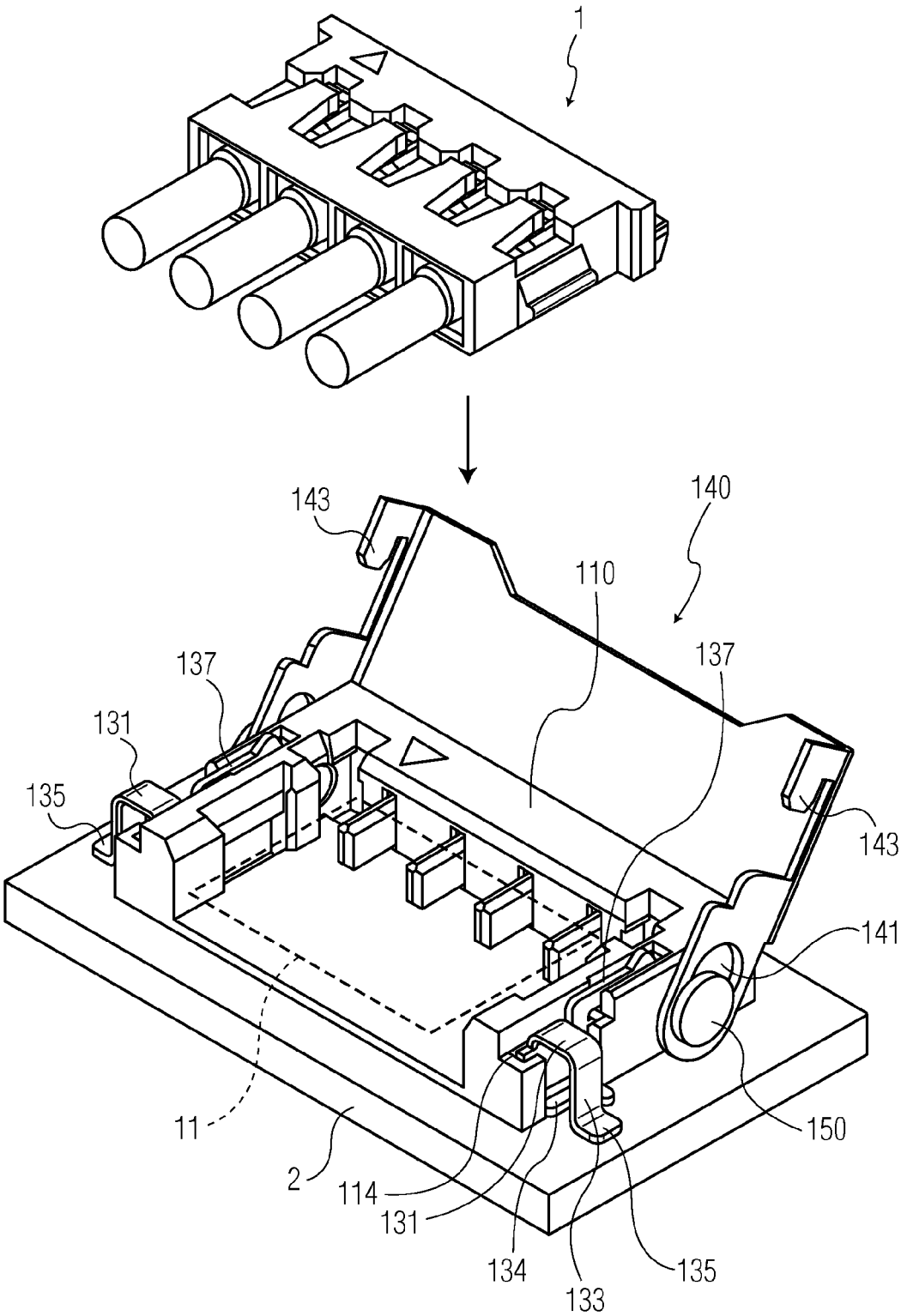
FIG. 13 is an exploded view of the receptacle connector shown in FIG. 9, shown secured to the circuit board and be assembled with a cable plug.
Figure 14:
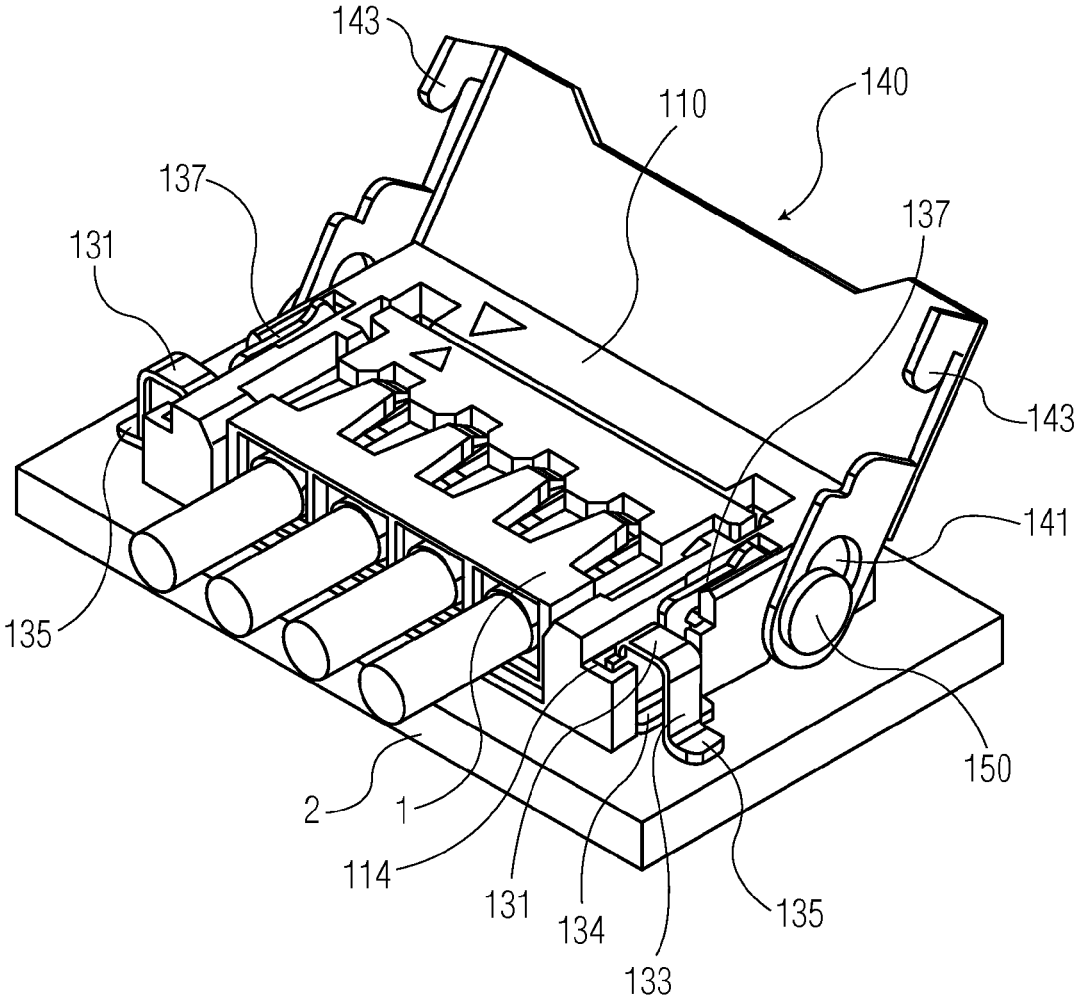
FIG. 14 is a perspective view of the receptacle connector fixed to a circuit board and the cable plug received in a plug receiving space according to the invention.
Figure 15:
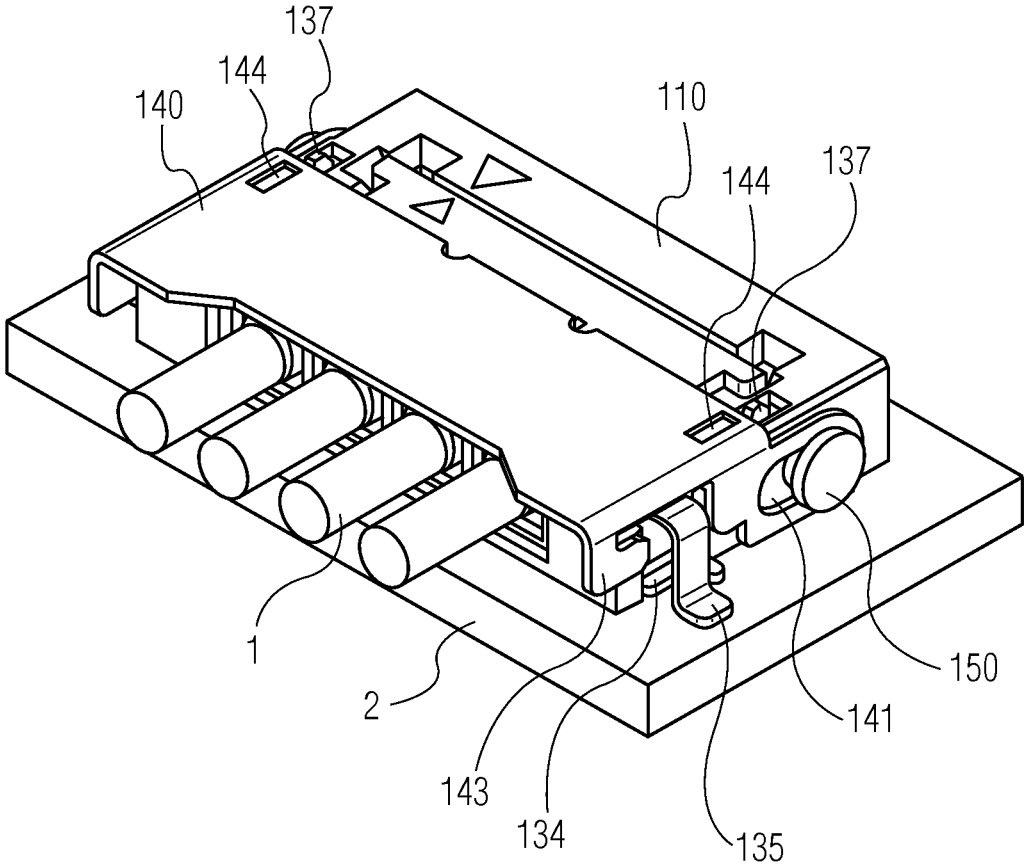
FIG. 15 is a perspective view of the receptacle connector of FIG. 14, showing a rotatable cover to secure the cable plug.
Figure 16:
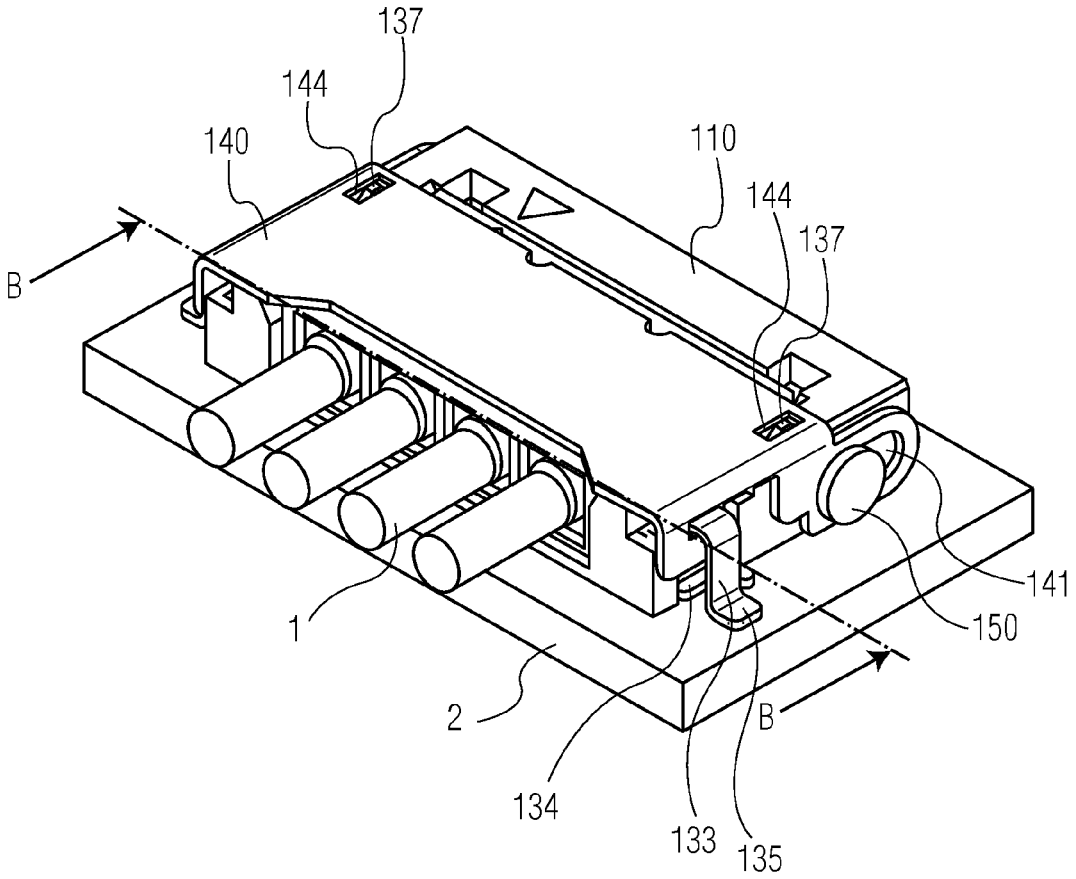
FIG. 16 is a perspective view of the receptacle connector of FIG. 15, shown secured to the circuit board and connected to the cable plug.
Figure 17:
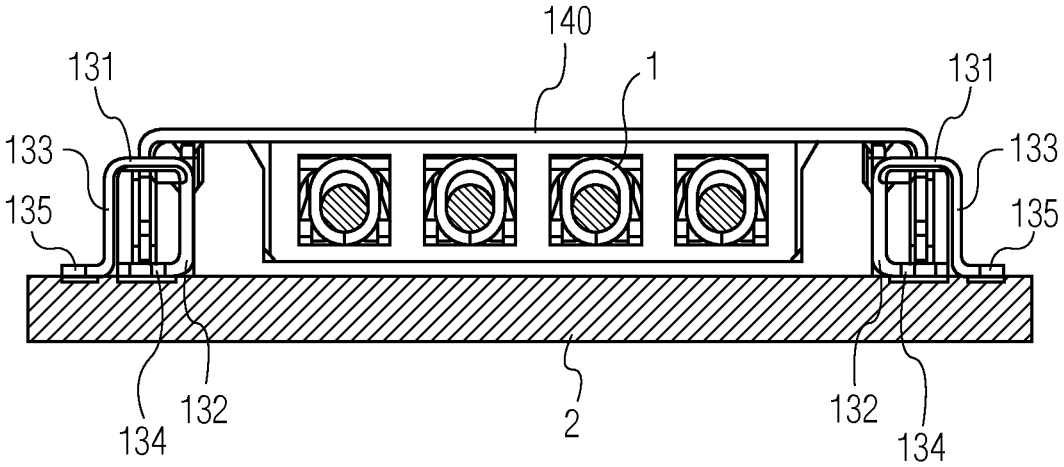
FIG. 17 is a cross-sectional view of the receptacle connector of FIG. 16 taken along line B-B.

Now with reference to FIGS. 13 through 17, assembly of the receptacle connector 200 to a circuit board 2 and a cable plug connector 1 is described, such that the cable plug connector 1 is electrically connected to the receptacle connector 200, which is soldered to the circuit board 2. First, the cable plug connector 1 is inserted or positioned into the plug receiving space 112 through the open end of the insulating casing 110, such that a conductive terminal in the terminal receiving portion 111 is electrically connected to a conductive terminal of the cable plug connector 1. The cylindrical pivotal connection portion 153 with the oval-shaped is positioned with the connection element receiving space 141 to thereby rotate the lid 140 downward about the pivotal connection portion 153, as shown in FIG. 13. Next, the cable plug connector 1 is covered by the lid 140 as shown in FIG. 14. Meanwhile, the pivotal connection portion 153 is disposed on one side of the connection element receiving space 141, whereas the engagement piece 143 is aligned with the engagement portion 136 and disposed outside the engagement portion 136 as shown in FIG. 15. Next, the lid 140 is moved horizontally, in order to cause the pivotal connection portion 153 to move from one side of the connection element receiving space 141 to the other side of the connection element receiving space 141. This causes the engagement piece 143 to engage with the engagement portion 136, and the catch 137 to engage with the catch receiving passageway 144 of the lid 140, such that the cable plug connector 1 is secured and electrically connected to the receptacle connector 200, as shown in FIG. 16. The first soldering portion 134 and the second soldering portion 135 of the pair of securing devices 130 are then secured to the circuit board 2 using a soldering process thereon with a solder, such that the receptacle connector 200 of the invention is firmly secured to the circuit board 2, as shown in FIG. 17.

The receptacle connector according to the invention is characterized such that when the cable plug is strongly pulled from the receptacle connector, the receptacle connector will remain firmly secured in place and thus unlikely to get disconnected or damaged.

While exemplary embodiments of the invention are described above, the above exemplary embodiments are not restrictive of the invention, and the foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A receptacle connector comprising:

an insulating casing having a front end with a plurality of terminal receiving passageways, a rear end with a plug receiving space, a pair of protrusions disposed on two sides of the plug receiving space and positioned proximate to the plurality of terminal receiving passageways, respectively, and a securing device receiving space disposed on one of the two sides and positioned distal to the plurality of terminal receiving passageways;

a plurality of terminals disposed in the plurality of terminal receiving passageways of the insulating casing, respectively;

a securing device disposed in the securing device receiving space and having a horizontal portion, a first vertical portion and a second vertical portion extending downward from the horizontal portion, a first soldering portion extending horizontally from the first vertical portion toward the second vertical portion, a second soldering portion extending horizontally from the second vertical portion and away from the first vertical portion, and an engagement portion defined by and between the first vertical portion and the second vertical portion; and a cover pivotally connected to the insulating casing and having a first protrusion receiving passageway and a second protrusion receiving passageway which communicate with each other and correspond in position with the pair of protrusions, respectively, and an engagement piece corresponding in position to the engagement portion and extending from a body of the cover.

2. The receptacle connector of claim 1, wherein the second soldering portion extends toward the first soldering portion.

3. The receptacle connector of claim 2, wherein each of the pair of protrusions extends into the first protrusion receiving passageway and is slidable into the second protrusion receiving passageway.

4. The receptacle connector of claim 3, wherein the engagement piece includes a projection that extends into the engagement portion when the pair of protrusions are positioned in the second protrusion receiving passageway.

5. A receptacle connector comprising:

an insulating casing having a plug receiving space, a pair of protrusions disposed on two sides of the plug receiving space, and a pair of securing device receiving spaces disposed on the two sides of the plug receiving space, respectively;

a plurality of terminal receiving passageways disposed in the insulating casing and extending into the plug receiving space;

a pair of securing devices disposed in the pair of securing device receiving spaces, respectively, each of the pair of securing devices having a horizontal portion, a vertical portion extending downward from the horizontal portion, and a fixed connection portion having a pair of soldering portions extending horizontal from the vertical portion; and a cover pivotally connected to the insulating casing and having a first protrusion receiving passageway and a second protrusion receiving passageway positioned adjacent to the first protrusion receiving passageway such that one of the pair of protrusions extends through the first protrusion receiving passageway and is movable into to the second protrusion receiving passageway.

6. The receptacle connector of claim 5, wherein the pair of protrusions are cylindrical.

7. The receptacle connector of claim 5, wherein the pair of securing device receiving spaces are substantially T-shaped.

8. The receptacle connector of claim 5, wherein the pair of securing devices are substantially inverted U-shaped.

9. The receptacle connector of claim 5, wherein the first protrusion receiving passageway and the second protrusion receiving passageway communicating therewith are two round holes that overlap with each other.

10. The receptacle connector of claim 5, wherein the vertical portion comprises a first vertical portion extending downward from a side of the horizontal portion and a second vertical portion extending downward from an opposite side of the horizontal portion.

11. The receptacle connector of claim 10, further comprising an engagement portion defined by and between the first vertical portion and the second vertical portion.

12. The receptacle connector of claim 11, wherein the cover includes an engagement piece that corresponds to the engagement portion.

13. The receptacle connector of claim 12, wherein the engagement piece is substantially barb-shaped.

14. A receptacle connector comprising:

an insulating casing having a front end with a plurality of terminal receiving passageways, a rear end with a plug receiving space, and a securing device receiving space disposed on one of two sides and positioned distal to the plurality of terminal receiving passageways;

a lid being pivotally connected to opposite sides of the insulating casing and having a surface with a catch receiving passageway passing there through, a pair of connection element receiving spaces positioned at one end of the lid, and an engagement piece disposed on an opposite end of the lid; and a securing device positioned in the securing device receiving space and having a body with a horizontal portion and a pair of vertical portions extending downward from the horizontal portion, an engagement portion defined by and between the vertical portions to correspond with the engagement piece and a catch extending from the body and corresponding with the catch receiving passageway.

15. The receptacle connector of claim 14, wherein one of the pair of connection element receiving spaces is oval-shaped.

16. The receptacle connector of claim 14, further comprising a pair of connection element portions extending through the insulating casing and corresponding in position to the pair of connection element receiving spaces.

17. The receptacle connector of claim 16, wherein each of a pair of connection elements has a holding portion, a pivotal connection portion, and a second connecting portion being disposed between the holding portion and the pivotal connection portion and being connectable with one of the pair of connection element portions.

18. The receptacle connector of claim 17, wherein each of the pair of connection element portions is a screw hole and the second connecting portion is threaded to engage the screw hole.

19. The receptacle connector of claim 17, wherein the pair of connection elements are rivet-shaped.

20. The receptacle connector of claim 17, further comprising a pair of stopper receiving passageways extending through a bottom side of the insulating casing and into the pair of connection element portions respectively.

21. The receptacle connector of claim 20, wherein the holding portion is positioned within the pair of stopper receiving passageways and the pivotal connection portion is disposed outside the insulating casing and positioned corresponding to a side of one of the pair of connection element receiving spaces.

22. The receptacle connector of claim 21, further comprising a pair of stoppers penetrating the pair of stopper receiving passageways and engaging the holding portion.

23. The receptacle connector of claim 22, wherein the holding portion is cylindrical and the pair of stoppers are semicircular to engage with the holding portion.

24. A receptacle connector comprising:

an insulating casing having a front end with a plurality of terminal receiving passageways, a rear end with a plug receiving space, a pair of protrusions disposed on two sides of the plug receiving space and positioned proximate to the plurality of terminal receiving passageways, respectively, and a securing device receiving space disposed on one of the two sides and positioned distal to the plurality of terminal receiving passageways;

a plurality of terminals disposed in the plurality of terminal receiving passageways of the insulating casing, respectively;

a securing device disposed in the securing device receiving space and having a horizontal portion, a first vertical portion and a second vertical portion extending downward from the horizontal portion, a first soldering portion extending horizontally from the first vertical portion, a second soldering portion extending horizontally from the second vertical portion and toward the first soldering portion, and an engagement portion defined by and between the first vertical portion and the second vertical portion; and a cover pivotally connected to the insulating casing and having a first protrusion receiving passageway and a second protrusion receiving passageway which communicate with each other and the pair of protrusions such that the pair of protrusions extends into the first protrusion receiving passageway and are slidable into the second protrusion receiving passageway, and an engagement piece having a projection extending from a body of the cover and into the engagement portion when the pair of protrusions are positioned in the second protrusion receiving passageway.

25. A receptacle connector comprising:

an insulating casing having a front end with a plurality of terminal receiving passageways, a rear end with a plug receiving space, and a securing device receiving space disposed on one of two sides and positioned distal to the plurality of terminal receiving passageways;

a lid being pivotally connected to opposite sides of the insulating casing and having a surface with a catch receiving passageway passing there through, a pair of connection element receiving spaces positioned at one end of the lid, and an engagement piece disposed on an opposite end of the lid;

a securing device positioned in the securing device receiving space and having a body corresponding to the engagement piece and a catch extending from the body and corresponding with the catch receiving passageway;

a pair of connection element portions extending through the insulating casing and corresponding in position to the pair of connection element receiving spaces; and a pair of connection elements engageable with the pair of connection element portions and having a holding portion, a pivotal connection portion, and a second connecting portion being disposed between the holding portion and the pivotal connection portion and connectable with one of the pair of connection element portions.

26. The receptacle connector of claim 25, wherein each of the pair of connection element portions is a screw hole and the second connecting portion is threaded to engage the screw hole.

27. The receptacle connector of claim 25, wherein the pair of connection elements is rivet-shaped.

28. The receptacle connector of claim 25, further comprising a pair of stopper receiving passageways extending through a bottom side of the insulating casing and into the pair of connection element portions respectively.

29. The receptacle connector of claim 28, wherein the holding portion is positioned within the pair of stopper receiving passageways and the pivotal connection portion is disposed outside the insulating casing and positioned corresponding to a side of one of the pair of connection element receiving spaces.

30. The receptacle connector of claim 29, further comprising a pair of stoppers penetrating the pair of stopper receiving passageways and engaging the holding portion.

31. The receptacle connector of claim 30, wherein the holding portion is cylindrical and the pair of stoppers are semicircular to engage with the holding portion.

* * * * *